US010570697B1

(12) United States Patent
Sawyer

(10) Patent No.: US 10,570,697 B1
(45) **Date of Patent: *Feb. 25, 2020**

(54) SYSTEM AND METHOD OF SEALING A SUBSURFACE LUBRICATOR FOR WELL SERVICING

(71) Applicant: MS DIRECTIONAL, LLC, Conroe, TX (US)

(72) Inventor: Terry L. Sawyer, Conroe, TX (US)

(73) Assignee: MS Directional, LLC, Conroe, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/046,644

(22) Filed: Jul. 26, 2018

Related U.S. Application Data

(63) Continuation of application No. 15/612,092, filed on Jun. 2, 2017, now Pat. No. 10,066,462.

(51) Int. Cl.

| | |
|---|---|
| ***E21B 34/14*** | (2006.01) |
| ***E21B 33/03*** | (2006.01) |
| ***E21B 29/04*** | (2006.01) |
| *E21B 34/00* | (2006.01) |

(52) U.S. Cl.
CPC ..... *E21B 34/14* (2013.01); *E21B 29/04* (2013.01); *E21B 33/03* (2013.01); *E21B 2034/005* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 3,532,163 | A | * | 10/1970 | Ecuer | E21B 33/076 166/53 |
| 3,568,767 | A | * | 3/1971 | Weiss | E21B 33/076 166/351 |
| 3,860,066 | A | * | 1/1975 | Pearce | E21B 34/08 137/458 |
| 3,924,686 | A | * | 12/1975 | Arnold | E21B 33/072 166/381 |
| 4,062,406 | A | * | 12/1977 | Akkerman | E21B 34/102 166/323 |
| 4,489,780 | A | * | 12/1984 | Duhon | E21B 33/072 137/875 |
| 4,886,115 | A | | 12/1989 | Leggett et al. | |

(Continued)

FOREIGN PATENT DOCUMENTS

| | | | | |
|---|---|---|---|---|
| GB | 2402409 | A | * 12/2004 | E21B 29/08 |

*Primary Examiner* — Cathleen R Hutchins
*Assistant Examiner* — Ronald R Runyan
(74) *Attorney, Agent, or Firm* — Jackson Walker, LLP

(57) ABSTRACT

The disclosure provides a lubricator system and method for entering the oil/gas wellhead or casing head with a wireline and tool while being able to safely shut or contain well pressure build up. The lubricator is coupled with a lubricator cutting flapper valve and can be attached to a wellhead on the oil/gas well, so that the lubricator extends below the wellhead. The wellhead can be opened, allowing the wireline and tool to enter into the bore. The tool is attached to a wireline cable that is controlled on the surface by means of a spooled drum attached to a portable or mobile machine or equipment. The lubricator cutting flapper valve includes structure that can sever the wireline and seal the lubricator to avoid allowing well gas or fluids to escape if necessary.

13 Claims, 10 Drawing Sheets

(56) References Cited

U.S. PATENT DOCUMENTS

| | | | | |
|---|---|---|---|---|
| 4,993,492 | A * | 2/1991 | Cressey | E21B 33/076 166/339 |
| 7,114,563 | B2 | 10/2006 | Rose | |
| 7,422,055 | B2 | 9/2008 | Cruickshank et al. | |
| 7,584,797 | B2 * | 9/2009 | Dallas | E21B 33/068 166/378 |
| 2003/0221844 | A1 | 12/2003 | Dallas | |
| 2007/0012449 | A1 | 1/2007 | Cruickshank et al. | |

* cited by examiner

SYSTEM AND METHOD OF SEALING A SUBSURFACE LUBRICATOR FOR WELL SERVICING

CROSS REFERENCE TO RELATED APPLICATIONS

Not applicable.

STATEMENT REGARDING FEDERALLY SPONSORED RESEARCH OR DEVELOPMENT REFERENCE TO APPENDIX

Not applicable.

BACKGROUND OF THE INVENTION

Field of the Invention

The disclosure generally relates to oilfield equipment and processes. More specifically, the disclosure relates to equipment and process used for lubricating tools and tubing passing into an oil or gas well with the ability to seal an opening of a lubricator.

Description of the Related Art

A typical oil/gas well wireline lubricator of a hollow steel pipe is attached to the top side of the wellhead or casing protruding upwards by at least one tool length of the wireline tool that will enter the wellbore. The lubricator allows the wellhead valves to be opened, so that the wireline tool can enter, while preventing any well gases or fluids from being released into the atmosphere. The lubricator is able to withstand a rated pressure and allow for full enclosure of the well opening by being affixed by means of a threaded steel connection or by a mating steel flange at the bottom end and bolted atop of the wellhead flange. The top end of the lubricator is enclosed with an attached sealable entry mechanism commonly known as a pack-off unit which is commercially available or custom built for the job application. The pack-off unit allows for the wireline cable attached to the wireline tool to be fed into the lubricator top opening when lowering the tool, while creating a seal around the wireline cable to prevent gas or fluids from exiting the well.

Some patents regarding lubrication are referenced below and are incorporated by reference herein. U.S. Pat. No. 3,924,686 entitled "Wellhead Lubricator Method" discloses "[a]n improved wellhead lubricator having a housing arranged for vertically extending attachment to a wellhead assembly and having a wireline for supporting a wireline tool therein and passing the wireline tool in and out of the well through the point of attachment to the wellhead. The improvement in this wellhead lubricator relates to the housing having a portion extending laterally from the vertically extending portion of the housing and which portion forms a part of the pressurized chamber of the housing. This laterally extending portion has another tool opening for passage of a wireline tool therethrough while the housing remains attached to the wellhead. A plug is adapted for closing this other tool opening after passage of the wireline tool therethrough. A guide bar is supported in the housing for guiding a wireline tool to the other opening when the tool is to be removed from the housing. Preferably, the other opening is located near the bottom of the laterally extending portion of the housing, whereby wireline tools may be raised and lowered into and out of the lubricator through the other opening by use of the conventional wireline operating through the lubricator."

U.S. Pat. No. 4,489,780, entitled "Wellhead Lubricator" discloses "[a] wellhead lubricator comprising a housing arranged for vertically extending attachment to a wellhead assembly and having a wireline for supporting a wireline tool therein and passing the wireline tool in and out of the well to the point of attachment to the wellhead; a laterally extending portion of the 2*u* housing forming a part of the chamber of the housing; a longitudinally extending portion extending from the laterally extending portion and having an opening for passage of a wireline tool therethrough while the housing remains attached to the wellhead; a cap for closing the tool opening; a guide supported in the housing and shiftable between a first position for guiding the wireline tool in and out of the well through the point of attachment to the wellhead and a second position for guiding the wireline tool to the longitudinally extending portion; a spring-actuated valve member for urging the guide to the second position for guiding the wireline tool to the longitudinally extending portion; and a fluid-actuated valve member for urging the guide to the first position for guiding the wireline tool in and out of said well at the point of attachment to the wellhead."

U.S. Pat. No. 4,993,492, entitled "METHOD OF INSERTING WIRELINE INTO A SUB-SEA WELLHEAD" discloses "[a] subsea wireline lubricator comprises in sequence a (a) stuffing box, (b) at least one blow-out preventer, (c) a riser, (d) a foot valve and (e) a connector for connection to a subsea wellhead assembly. The lubricator permits wireline access to subsea oil wells without the need for a conventional tensioned riser."

U.S. Pat. No. 7,584,797, entitled "METHOD OF SUBSURFACE LUBRICATION TO FACILITATE WELL COMPLETION" discloses "[a] method of subsurface lubrication facilitates well completion, re-completion and workover while increasing safety and reducing expenses. The method involves using a subsurface lubricator mounted to a wellhead of the cased wellbore to lubricate a downhole tool string into the cased wellbore by running a subsurface lubricator through the wellhead and into an upper section of a production casing of the cased wellbore."

The length of the wellhead lubricator extending above the well can cause safety issues in some operations that combine equipment and steps. Some efforts have been made to place the lubricator under the wellhead. However, that placement bypasses the safety of the shutoff valving of the wellhead, because the wireline in the lubricator passes through the valving and prevents the valving from operation.

Therefore, there remains a need to locate the lubricator below the wellhead and yet seal the well to prevent gas or fluids from exiting the well, while the wireline is in the well.

BRIEF SUMMARY OF THE INVENTION

The present disclosure provides a lubricator system and method for entering the oil/gas wellhead or casing head with a wireline and tool, while being able to safely shut or contain well pressure build up. The lubricator is coupled with a lubricator cutting flapper valve and can be attached to a wellhead on the oil/gas well, so that the lubricator extends below the wellhead, and a wireline and tool can be inserted through the lubricator and the lubricator cutting flapper valve. Alternately, the tool may be inserted into the lubricator and then the lubricator is installed to the wellhead, so that the lubricator extends below the wellhead. The wellhead can be opened, allowing the wireline and tool to enter into the bore. The tool can be attached to a wireline cable that is controlled on the surface by means of a spooled drum attached to a portable or mobile machine or equipment. If necessary to seal the lubricator, the lubricator cutting flapper valve includes structure that can sever the wireline and seal the lubricator to avoid allowing well gas or fluids to escape through the lubricator.

The present disclosure provides a system for sealing a wireline lubricator installed in an oil or gas well, comprising: a lubricator cutting flapper valve coupled to the lubricator, comprising: a hydraulic piston housing and a hydraulic cylinder head that forms a chamber therein; a piston with a piston seal slidably disposed in the chamber, the piston having a bore through a central portion of the piston so that an object can pass through the flapper valve including the piston when the flapper valve is open; at least one cut-off blade rotatably coupled to the valve and configured to be closed by a first end of the piston when the piston is actuated toward the cut-off blade and cut across the bore to the object disposed in the flapper valve; and a flapper rotatably coupled to the valve and configured to close and seal the bore in a closed position, and to open and allow the object to pass through the valve in an open position when the piston is actuated to move the flapper. The disclosure further comprises the wireline lubricator, wherein the lubricator is configured to be installed on a wellhead with at least a portion extending below the wellhead.

The present disclosure also provides a method of sealing a wireline lubricator installed in a wireline in an oil or gas well, comprising: providing a lubricator cutting flapper valve having a bore therethrough with at least one cut-off blade rotatably coupled to the valve and a flapper rotatably coupled to the valve with a piston slidably coupled in the valve, the valve being configured for coupling with the lubricator, the lubricator cutting flapper valve being configured to perform the following steps: actuating the piston in the valve a first direction and opening the flapper while allowing the cut-off blade to open to allow a wireline to pass through the bore of the valve; actuating the piston a second direction and closing the cut-off blade across the bore; and cutting the wireline in the bore with the cut-off blade if the wireline is in the bore while the cut-off blade closes across the bore to allow the wireline to drop below the valve and allow the flapper to close across the lubricator bore.

DETAILED DESCRIPTION

Figure 1:
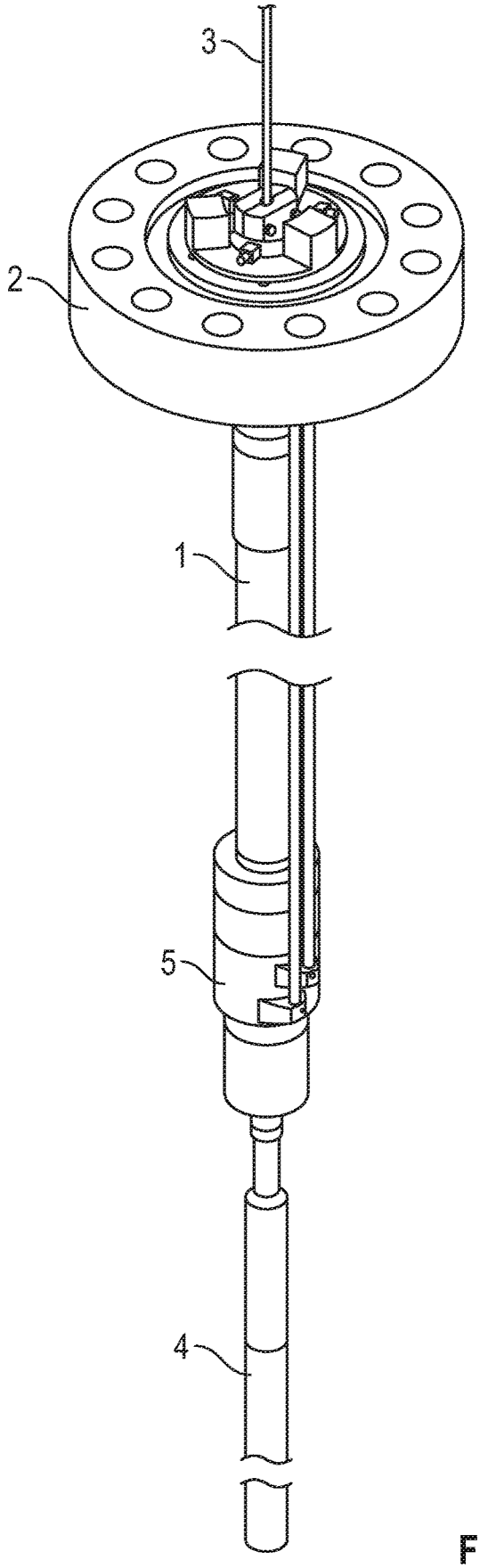
FIG. 1 is a schematic perspective view of a lubricator of the present invention coupled to a mating flange for coupling to a wellhead on an oil or gas well.

The Figures described above and the written description of specific structures and functions below are not presented to limit the scope of what Applicant has invented or the scope of the appended claims. Rather, the Figure and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are employed in the written description for clarity in specific reference to the Figures and are not intended to limit the scope of the invention or the appended claims. Terms "about" and "approximately" are equivalents. Any numerals used in this application with or without about/approximately are meant to cover any normal fluctuations appreciated by one of ordinary skill in the relevant art. Further, the various methods and embodiments of the system can be included in combination with each other to produce variations of the disclosed methods and embodiments Discussion of singular elements can include plural elements and vice-versa. References to at least one item may include one or more items. Also, various aspects of the embodiments could be used in conjunction with each other to accomplish the understood goals of the disclosure. Unless the context requires otherwise, the term "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The terms "coupled," "coupling," "coupler," and the like are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally. The order of steps can occur in a variety of sequences unless otherwise specifically limited. The various steps described herein can be combined with other steps, interlineated with the stated steps, and/or split into multiple steps. Some elements are nominated by a device name for simplicity and would be understood to include a system or a section or related components, such as seals, washers, fasteners, and the like that are known to those with ordinary skill in the art and may not be specifically described.

Figure 2:
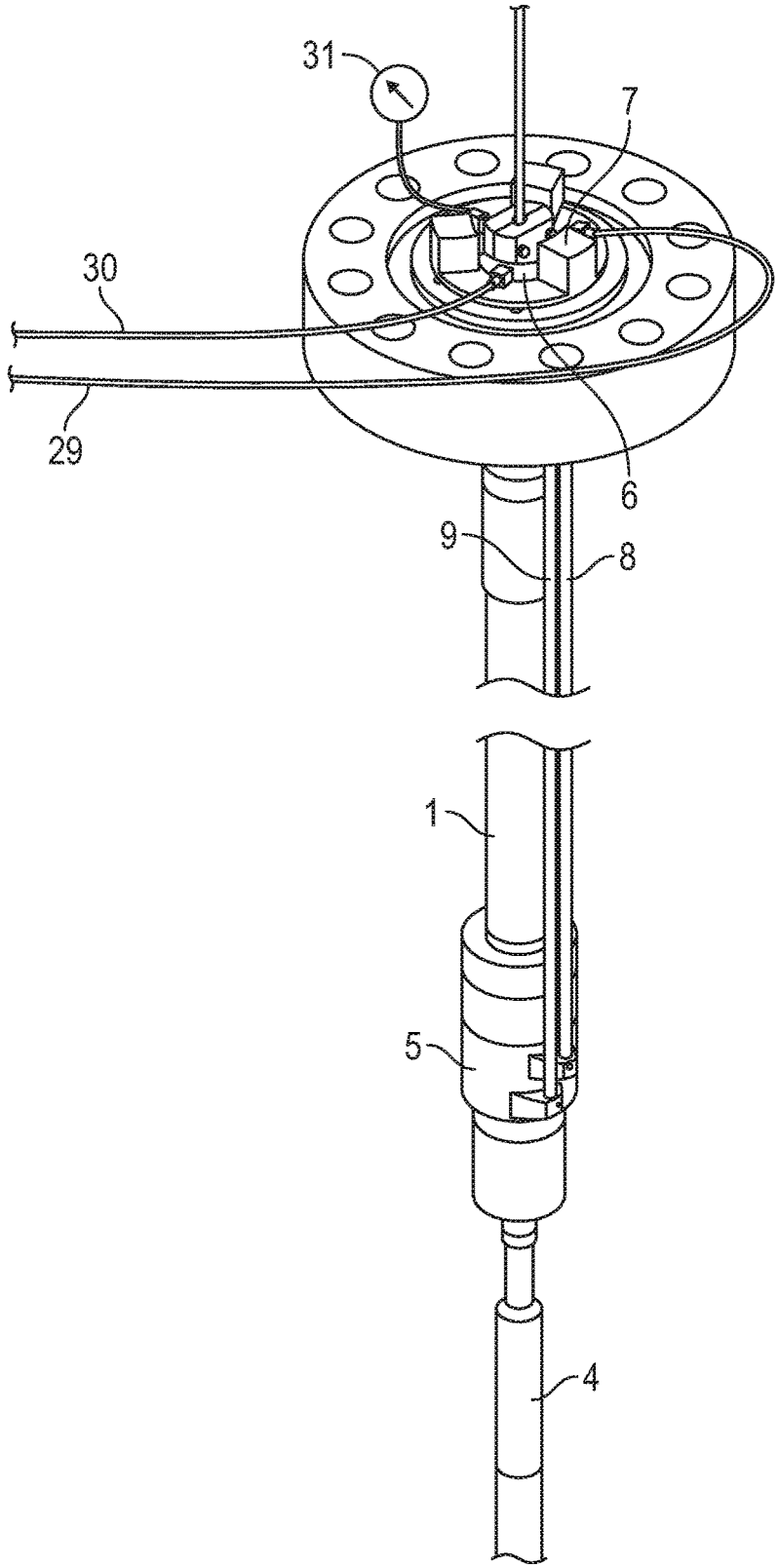
FIG. 2 is a schematic detailed view of FIG. 1.
Figure 3A:
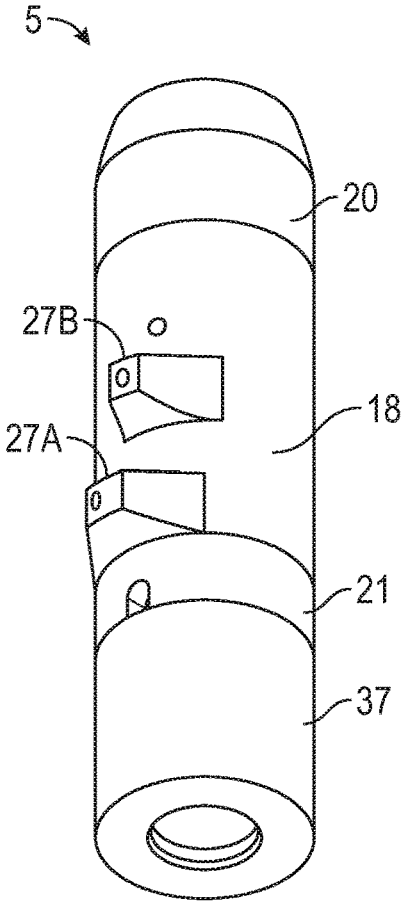
FIG. 3A is a schematic perspective view of the exemplary lubricator cutting flapper valve from a bottom perspective.
Figure 3B:
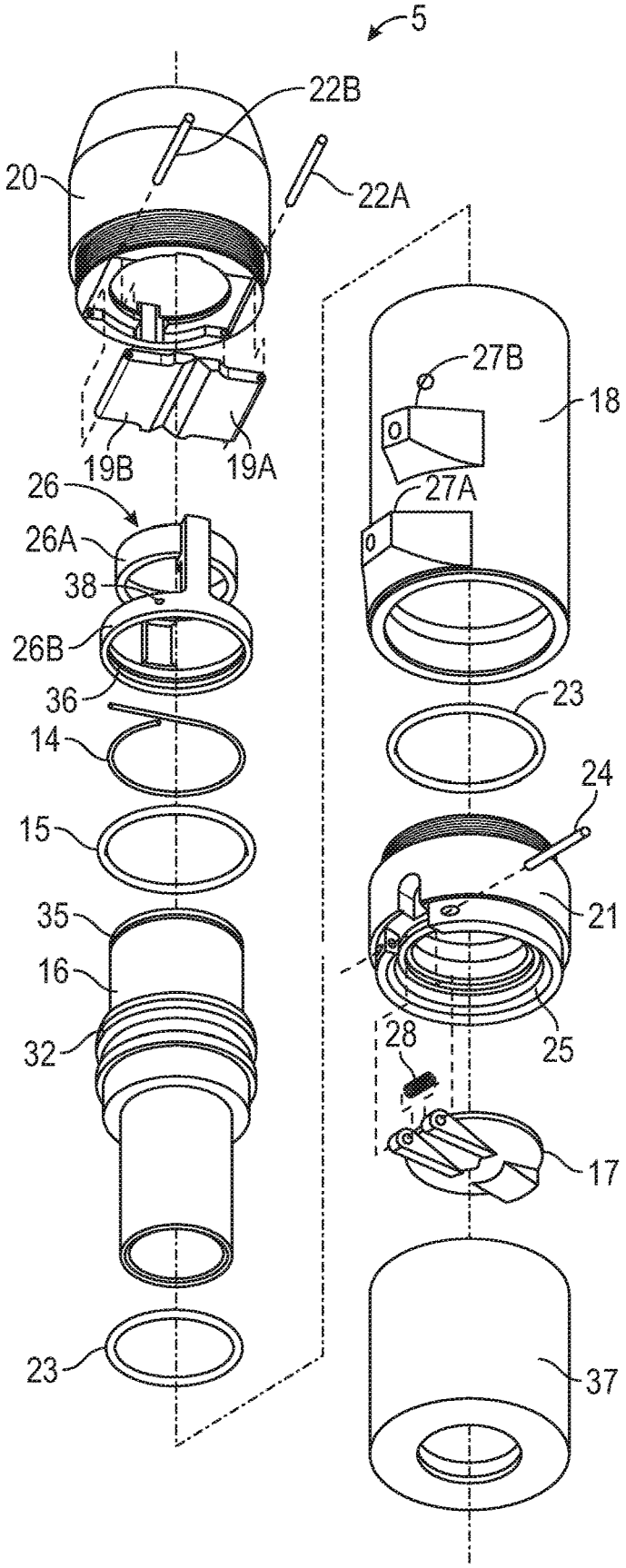
FIG. 3B is a schematic assembly view of the exemplary lubricator cutting flapper valve of FIG. 3A from a bottom perspective.
Figure 4:
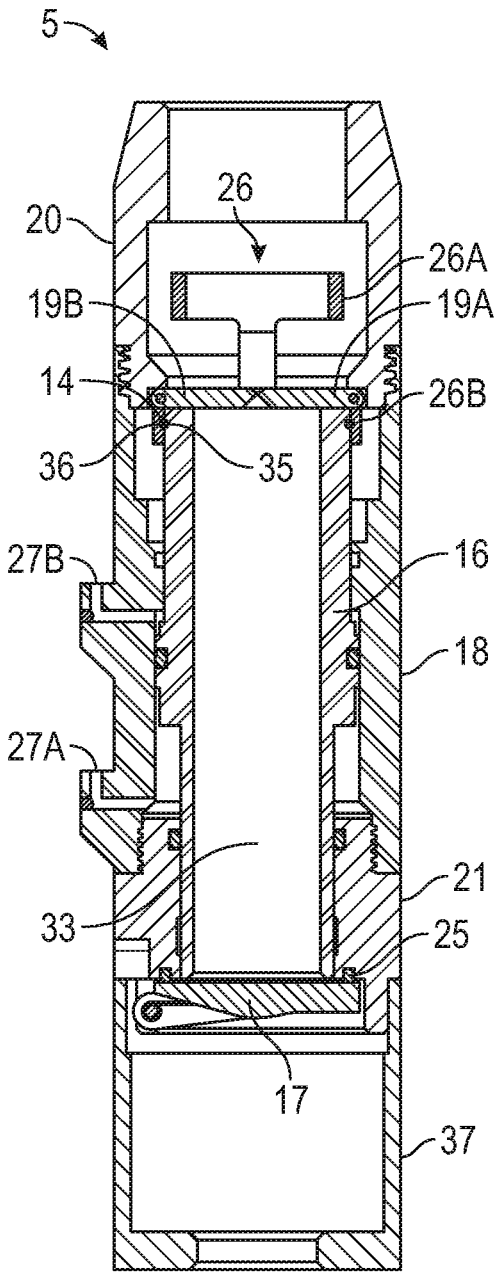
FIG. 4 is schematic cross sectional view of an exemplary lubricator cutting flapper valve in a closed position.
Figure 5:
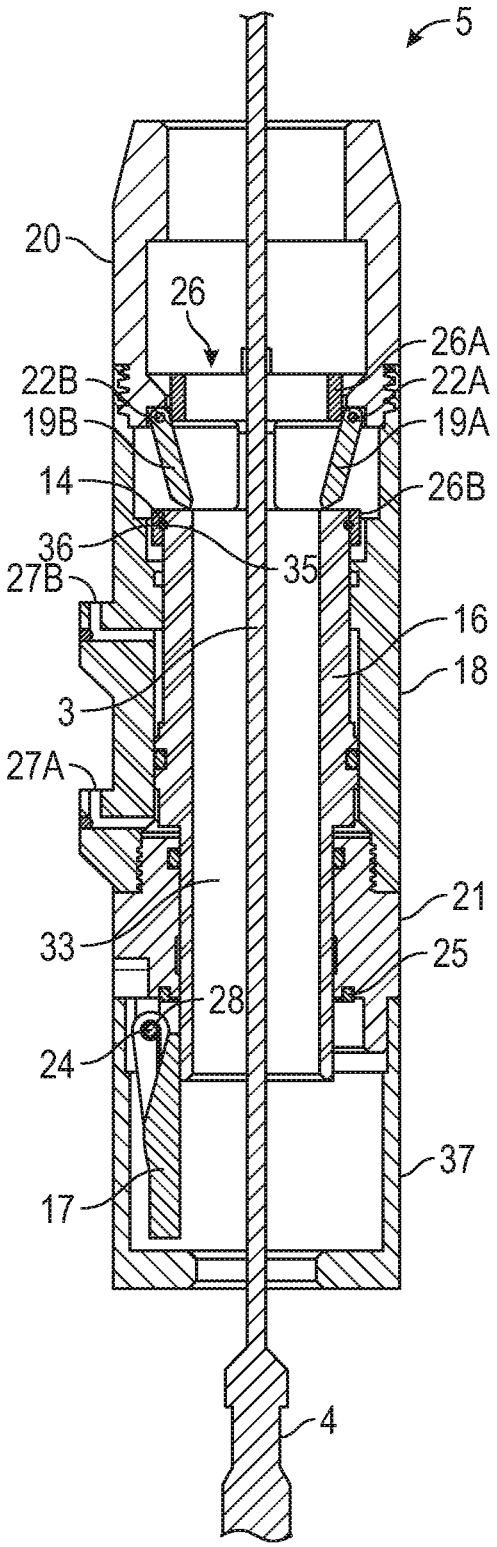
FIG. 5 is schematic cross sectional view of the exemplary lubricator cutting flapper valve in an open position.
Figure 6:
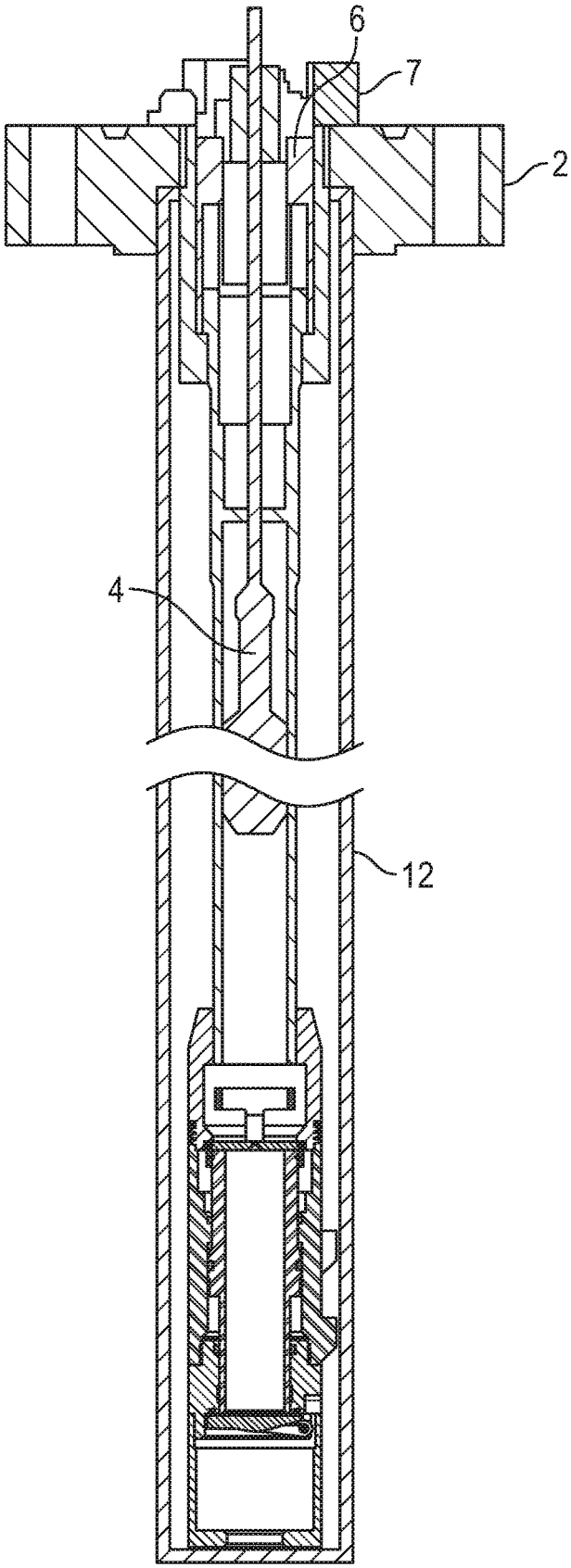
FIG. 6 is a schematic cross sectional view of the lubricator coupled with the mating flange with a wireline and tool disposed in the lubricator.
Figure 7A:
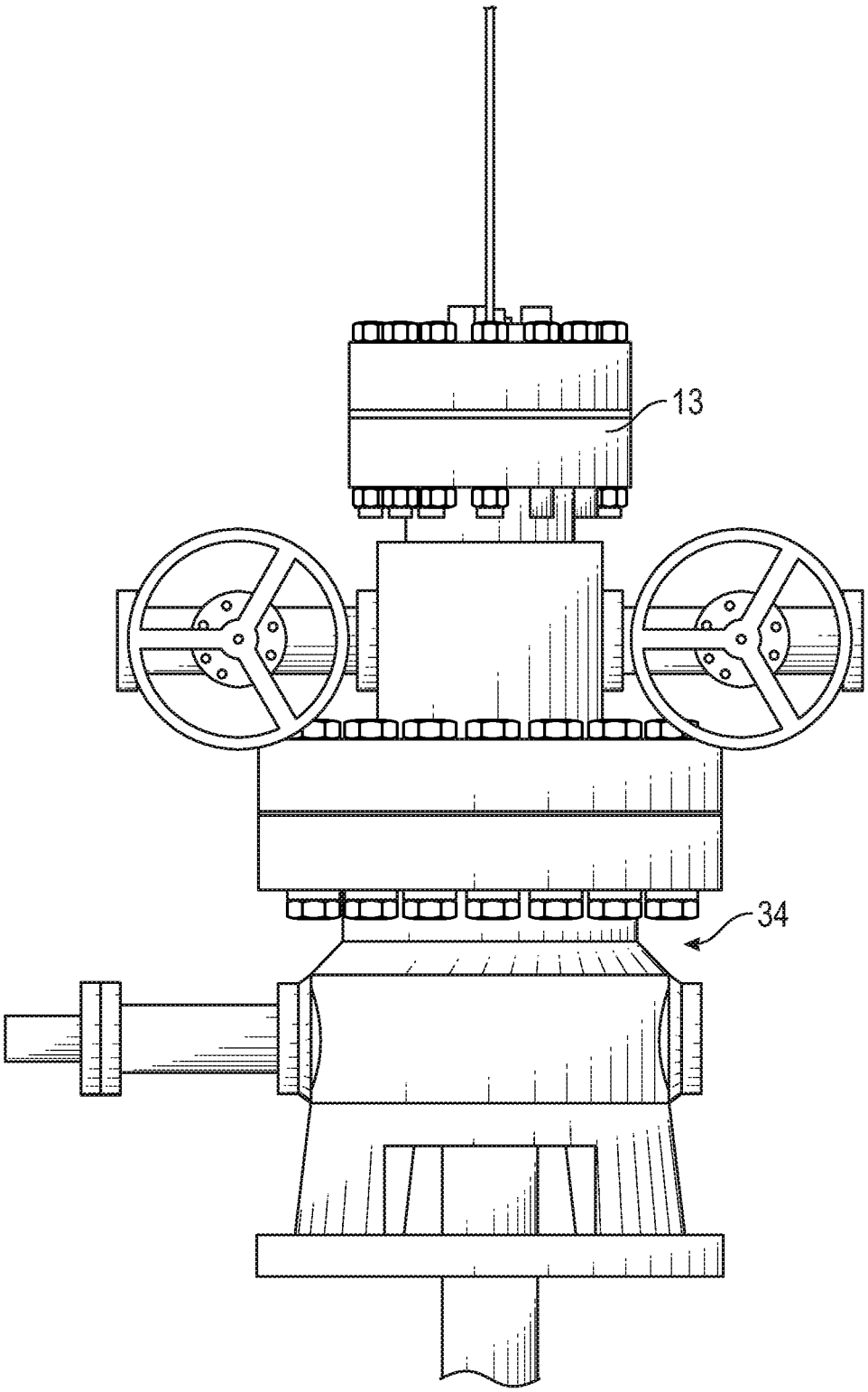
FIG. 7A is a schematic side view of a wellhead assembly with the exemplary lubricator and mating flange coupled thereto.
Figure 7B:
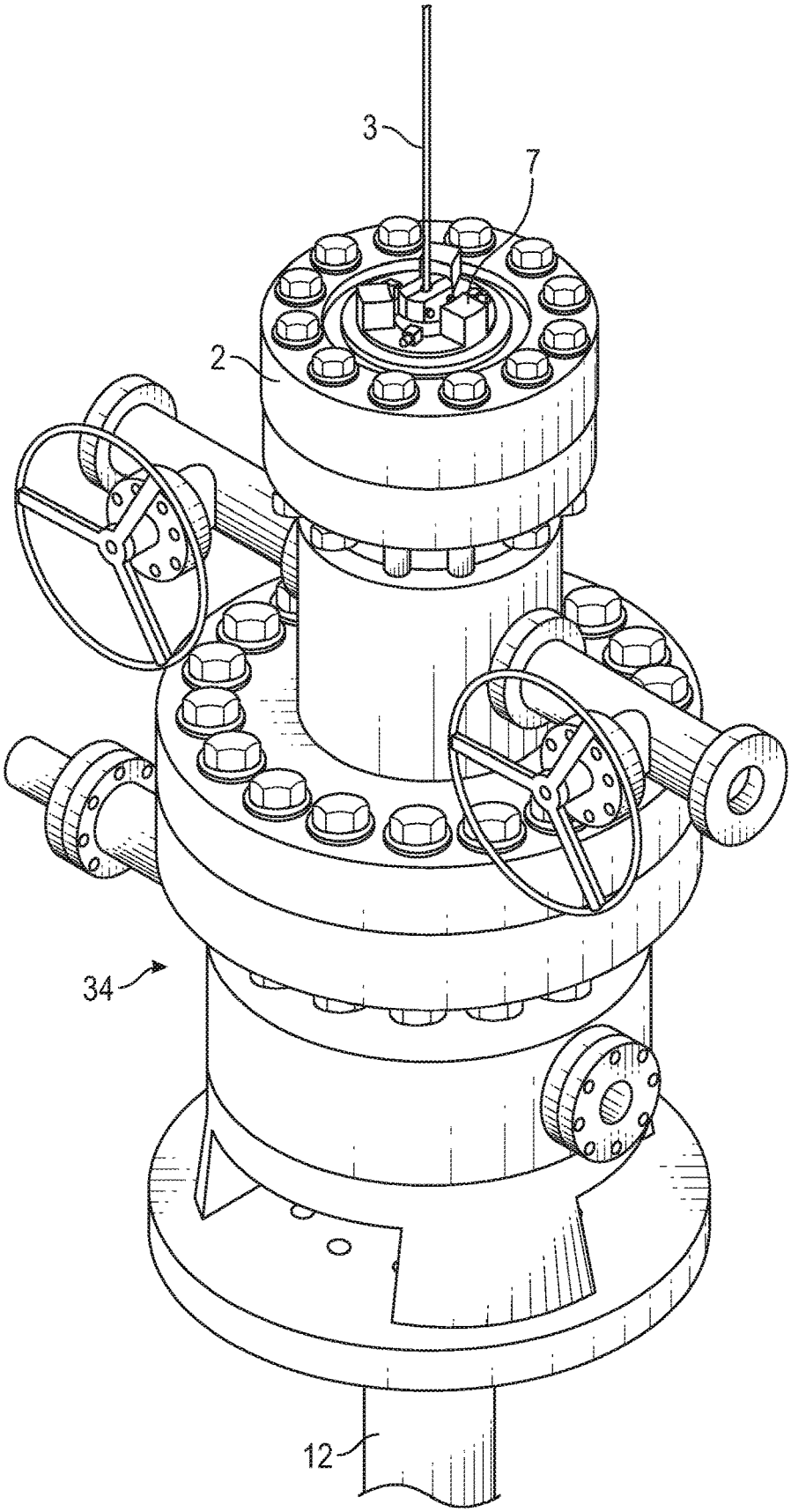
FIG. 7B is a schematic perspective view of the wellhead assembly with the exemplary lubricator and mating flange of FIG. 7A.
Figure 8:
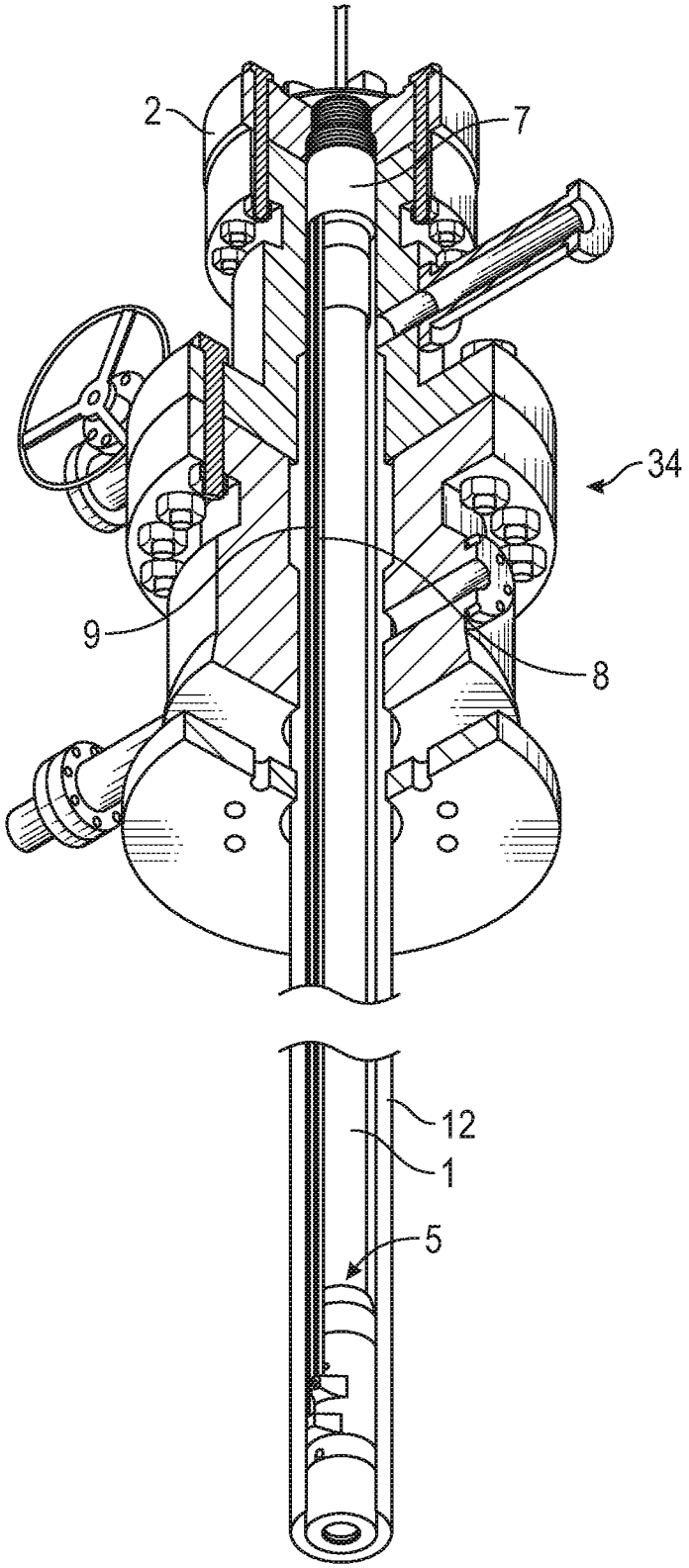
FIG. 8 is a schematic cross sectional view of the wellhead assembly of FIGS. 7A and 7B from a bottom perspective.
Figure 9:
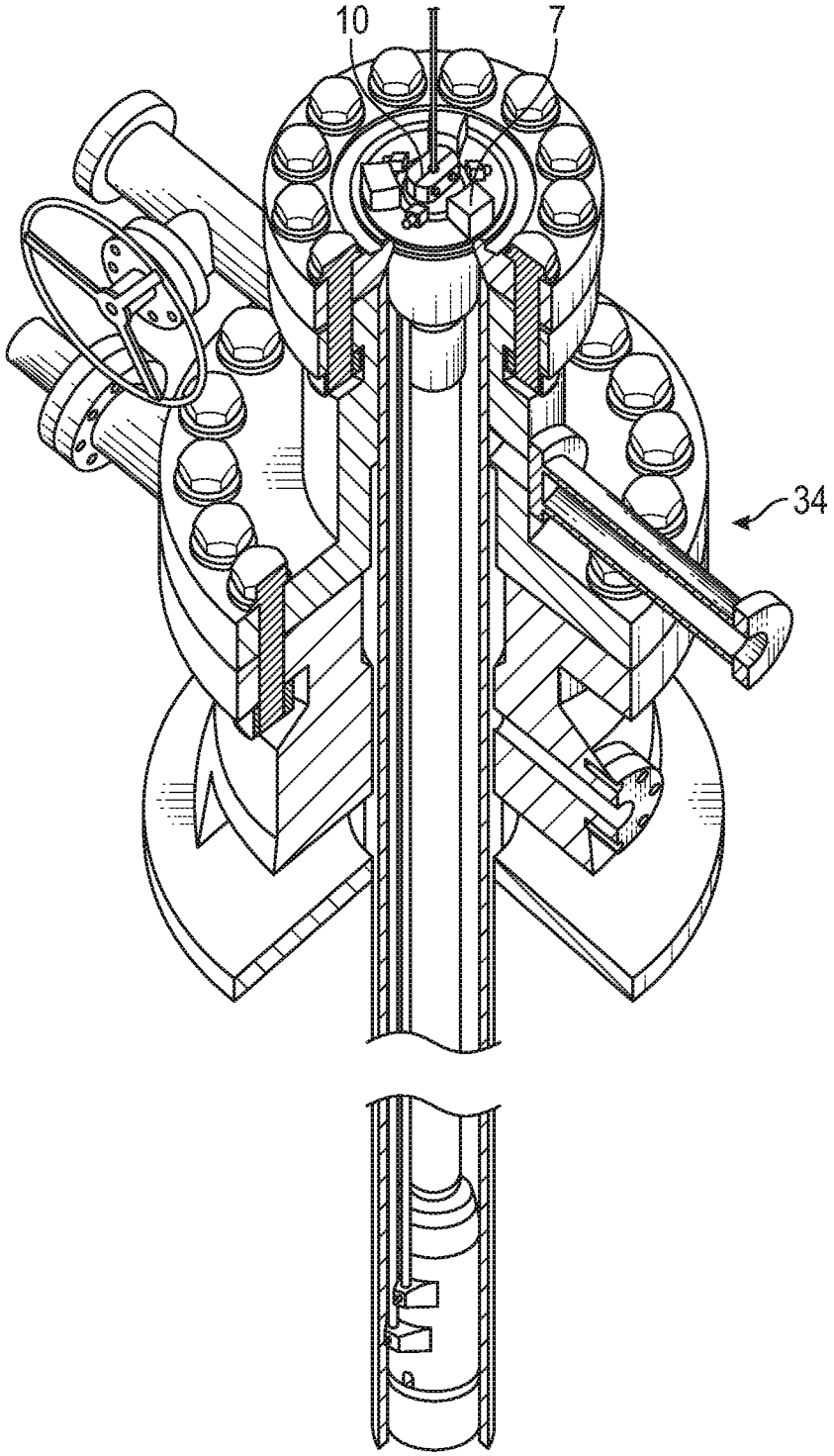
FIG. 9 is a schematic cross sectional view of the wellhead assembly of FIGS. 7A and 7B from a top perspective.
Figure 10A:
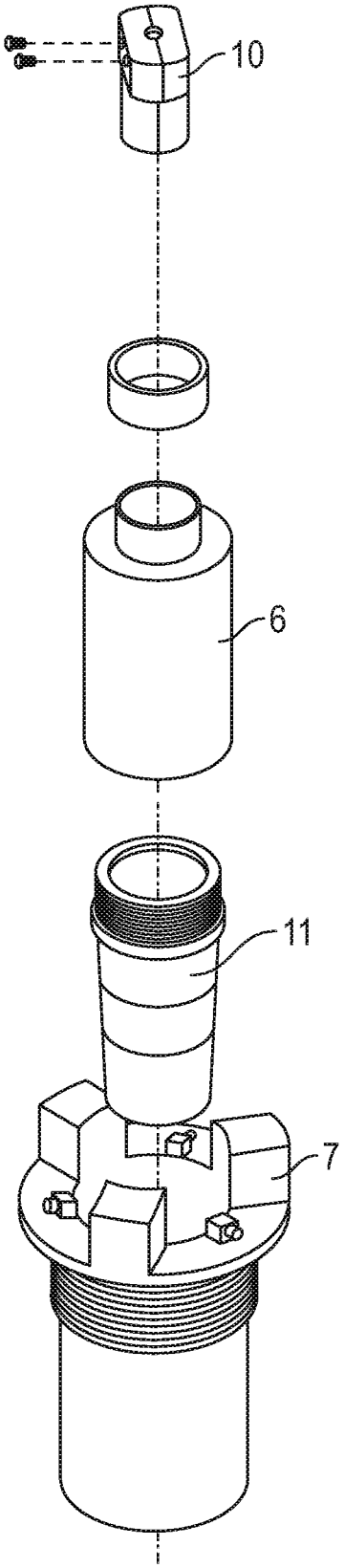
FIG. 10A is a schematic assembly view of a flange adapter from a top perspective.
Figure 10B:
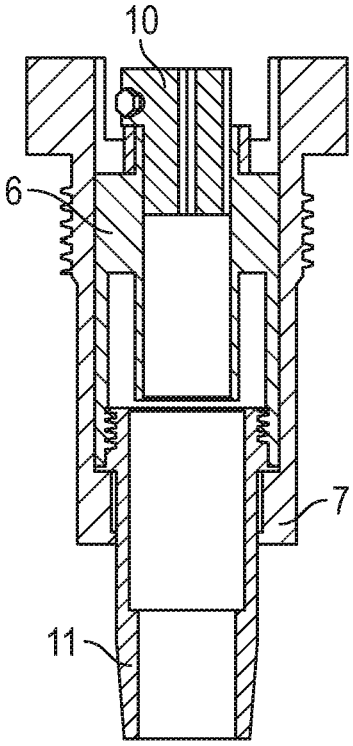
FIG. 10B is a schematic cross sectional view of the flange adapter of FIG. 10A.

FIG. 1 is a schematic perspective view of a lubricator of the present invention coupled to a mating flange for coupling to a wellhead on an oil or gas well. FIG. 2 is a schematic detailed view of FIG. 1. FIG. 3A is a schematic perspective view of the exemplary lubricator cutting flapper valve from a bottom perspective. FIG. 3B is a schematic assembly view of the exemplary lubricator cutting flapper valve of FIG. 3A from a bottom perspective. FIG. 4 is schematic cross sectional view of an exemplary lubricator cutting flapper valve in a closed position. FIG. 5 is schematic cross sectional view of the exemplary lubricator cutting flapper valve in an open position. FIG. 6 is a schematic cross sectional view of the lubricator coupled with the mating flange with a wireline and tool disposed in the lubricator. FIG. 7A is a schematic side view of a wellhead assembly with the exemplary lubricator and mating flange coupled thereto. FIG. 7B is a schematic perspective view of the wellhead assembly with the exemplary lubricator and mating flange of FIG. 7A. FIG. 8 is a schematic cross sectional view of the wellhead assembly of FIGS. 7A and 7B from a bottom perspective. FIG. 9 is a schematic cross sectional view of the wellhead assembly of FIGS. 7A and 7B from a top perspective. FIG. 10A is a schematic assembly view of a flange adapter from a top perspective. FIG. 10B is a schematic cross sectional view of the flange adapter of FIG. 10A. The figures will be described in conjunction with each other in this provisional application.

In general, a lubricator 1 can be mounted into a wellhead 34, the lubricator having a lubricator cutting flapper valve 5 with a piston 16. Advantageously, the lubricator can be to be mounted extending downwardly below the wellhead rather than upwardly above the wellhead to reduce the amount of clearance needed above the wellhead for tools and operations. The disclosure provides a solution to the problem of sealing an inverted lubricator that heretofore was not sealable when a wireline was inserted through the lubricator down the well. The piston 16 of the lubricator cutting flapper valve 5 can be hydraulically actuated to cut a wireline disposed therethrough and close the lubricator, if necessary, to restrict well gases or fluids from existing the lubricator. Importantly, the lubricator cutting flapper valve 5 can operate to seal the well when the typical valves of the wellhead are not operational due to the lubricator being inserted therethrough.

More specifically, the lubricator 1 generally can be a pipe of structural material, such as steel, that can be threaded on each end to be mounted with the wellhead 34. The lubricator can be coupled to a pipe adapter 11. The pipe adapter 11 can be coupled to the inside bore of a flange adapter 7. The flange adapter 7 can be coupled to an internal bore of a wellhead flange 2. The various components can have mating threads or other fastening means known to those in the art. Thus, the lubricator 1 can be supported by the above assembly coupled with the flange 2. A pack-off housing 6 can be inserted and coupled into a bore of the flange adapter 7 to help seal the bore of the flange adapter and more generally an opening that passes through the lubricator 1.

On the other end of the lubricator 1, a lubricator cutting flapper valve 5 can be coupled, such as by threads. At least one and generally at least two hydraulic hoses 29 and 30 can be coupled to ports on the flange adapter 7 or other suitable structure. The ports are fluidicly coupled to corresponding hydraulic hoses 8 and 9 that extend below the flange 2 to the ports 27A and 27B (generally herein "27") on the valve 5. The piston 16 in the cutting flapper valve 5 can be driven by a hydraulic pump that can be hand operated on the ground surface. Alternatively, a powered hydraulic pump that may be remote can operate the piston. Hydraulic fluid can be transferred through the hydraulic hoses 29 and 30 to the wellhead 34, and then through the hydraulic hoses 8 and 9 down the well to the ports 27 on the valve 5.

The assembled lubricator 1 with the lubricator cutting flapper valve 5 and other components can be placed into the wellbore through the wellhead 34 and lowered in place until the flange 2 rests upon a mating wellhead flange 13 where the flange 2 can be coupled with bolts or other fasteners thereto. The lubricator can extend downward below the wellhead into production tubing 12. A wireline 3 and tool 4 can be inserted into the lubricator 1 through the bore of the pack-off housing 6 in the flange adapter 7. A wireline clamp 10 can be coupled around the wireline 3 and positioned into the bore of the pack-off housing 6 to hold the wireline 3 and a tool 4 coupled thereto in various downhole positions.

The cutter flapper valve 5 is shown in more detail in the views of FIGS. 3A and 3B, and in closed and open positions in FIGS. 4 and 5, respectively. The stack of ringed components have bores that together align when assembled to form a bore 33 for the valve 5 through which the wireline 3 and tool 4 can be inserted into the well. The piston 16 with a rod and a piston seal 32 is slidably housed in a hydraulic piston housing 18. The piston housing 18 can include the hydraulic ports 27A and 27B through which hydraulic fluid can enter and exit to drive the piston 16 up and down, respectively, in the orientation shown herein. A cut-off blade body 20 and a hydraulic cylinder head 21 can be coupled to the piston housing 18 to form a pressure chamber in the flapper valve 5 in which the piston reciprocates by applying pressure below or above the piston seal 32 through the ports 27A and 27B, respectively. A seal 23 can seal between the piston housing 18 and the cylinder head 21.

The cut-off blade body 20 can be coupled to the piston housing 18 on one end and to the lubricator 1 on its other end. The cut-off blade body 20 can include one or more recesses milled or otherwise formed in the body 20. An attachment means can couple at least one and generally at least a pair of cut-off blades 19A, 19B (generally referenced herein as "19") to the blade body 20. In at least one embodiment, the cut-off blades are sized and designed to cut through a wireline if necessary in the well. In at least one embodiment, pins 22A, 22B (generally referenced herein as "22") can be inserted through openings in the blade body 20 and openings in the blades 19A, 19B to rotatably couple the elements, allowing the blades to rotate up and down.

In at least one embodiment, a lifting cage 26 and associated components can provide positive control of the opening of the cut-off blades 19 as the piston 16 reciprocates up and down. Without a positive control of the opening of the cut-off blades, the blades are not assured of opening by gravity, when the piston 16 retracts downward away from the cut-off blades. The lifting cage 26 can be disposed within the cut-off blade body 20 with an upper portion 26A disposed above the cut-off blades 19, that is, distal from the piston 16, and a lower portion 26B disposed below the cut-off blades, that is, proximal to the piston. The lower portion 26B can be coupled to the piston 16 by the interaction of a retaining member 14 with retainers formed in each of the piston and the lower portion 26B. More specifically, a piston retainer 35, such as a groove, can be formed in the external wall of the piston. A corresponding cage retainer 36, such as a groove, can be formed in the internal wall of the lower portion 26B for longitudinal alignment with the piston retainer. A seal 15 can be disposed between the piston retainer 35 and the cage retainer 36. A cage retainer opening 38 can be formed through the wall of the lower portion 26B and longitudinally aligned with the cage retainer 36. When the piston retainer 35 and cage retainer 36 are longitudinally aligned, a retaining member 14, such as a retaining wire, cord, or other flexible member, can be inserted through the cage retainer opening 38 and into both of the piston retainer 35 and the cage retainer 36. In other embodiments, a snap ring can be used. While inserted in the piston retainer 35 and the cage retainer 36, the retainer 14 couples the longitudinal movement of the piston 16 with the lifting cage 26.

An optional spring (not shown) can bias the cut-off blades 19 to a downward position, so that, if necessary to close in the well, upward movement of the piston 16 can force the cut-off blades into a closed position into a pinching action to shear the wireline 3 disposed in the cutting flapper valve 5.

The hydraulic cylinder head 21 can be coupled to the piston housing 18 on a distal end from the cut-off blade body 20. Being inverted into the wellhead in at least one embodiment, this system can include a flapper 17 coupled to the hydraulic cylinder head 21 distally from the piston housing. The flapper 17 can be rotatably coupled to the piston housing 18 by a pin 24 to allow the flapper to rotate up and down between closed and open positions. A spring 28 can be coupled between the piston housing 18 and the flapper 17 to bias the flapper to a closed position. The flapper 17 can close and seal the well when a wireline tool 4 is in the up position. A seal 25 can be inserted into a cavity in the piston housing 18 to provide a sealing surface for the flapper 17 in a closed position. A cap 37 can be coupled to the cylinder head 21 to protect the flapper 17 and have sufficient internal volume to allow the flapper to open and close without interference.

In operation, as the piston 16 moves downward, as shown in FIG. 5, the cut-off blades 19 move downward into an open position with the lifting cage 26. The cut-off blades 19 can follow the movement of the piston 16 downward by gravity and the flapper valve 17 is forced open by the piston 16. However, if the cut-off blades 19 are stuck in a closed position, the lifting cage 26 can force the cut-off blades to move downward with the piston. The upper portion 26B of the lifting cage 26 is pulled downward as the piston 16 moves downward and can contact the upper surfaces of the cut-off blades 19. The upper portion 26B can pull the cut-off blades downward as the upper portion 26B continues to travel downward.

Should the well need to be closed in or if the tool should be stuck while downhole, the piston 16 can be raised upward with hydraulic pressurized fluid through the port 27A to close the flapper valve 5. The spring 28 can close the flapper 17 when the piston is moved upward to clear the flapper, unless a wireline 3 is still in the bore 33 and interferes with the closing, such as shown in FIG. 5. To remove the wireline and its interference with closing the valve, the top of the piston can push against the cut-off blades 19 when the piston 16 moves upward, forcing the cut-off blades into a closed position, as shown in FIG. 4, across the bore 33 of the valve 5 and thereby cutting the wireline 3 disposed therebetween. Once the wireline 3 is cut, a lower cut portion of the wireline can drop below the flapper 17 by gravity to clear the bore 33 and allow the flapper to close the valve 5 and thus restrict well gases and fluids from passing through the lubricator bore. Pressure from the well side can be viewed from an attached gauge 31.

Other and further embodiments are possible and contemplated. For example, the shapes and orientations of the components can vary, the components can be manufactured as a combination of components, or as subcomponents that can be combined for an assembly, the hydraulics may be powered from a remote location, the lubricator can be positioned in a variety of locations, the shape and number of cut-off blades can vary, and the shape and number of elements of the flapper can vary, as well as the location of the cut-off blades relative to the flapper. Other examples of variations are possible within the scope of claims.

The invention has been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A wireline lubricator system for installing below a wellhead on an oil or gas well, comprising:

a wireline lubricator selectively sealable on an upper portion of the lubricator and having a bore configured to receive a wireline and a tool coupled to the wireline for insertion into production tubing in the well, the lubricator configured to be inserted into an opening in the wellhead to extend at least partially below the wellhead; and a cutting flapper valve mounted below the wellhead when installed in a well and coupled to the lubricator below the wellhead and configured to cut the wireline while mounted below the wellhead and seal a lower portion of the lubricator below the wellhead after the cut.

2. The wireline lubricator of claim 1, wherein a top of the lubricator is configured to be mounted to a wellhead and the remainder of the lubricator extends below the wellhead.

3. The wireline lubricator of claim 1, further comprising a flange coupled to an upper portion of the lubricator configured to couple to a mating flange on the wellhead, wherein the top of the lubricator is at the flange.

4. The wireline lubricator of claim 1, wherein the cutting flapper valve comprises:

at least one cut-off blade rotatably coupled inside the valve;

a piston coupled inside the valve and configured to push the cut-off blade in a first direction and;

a lifting cage configured to push the cut-off blade in an opposite direction.

5. The wireline lubricator of claim 1, wherein the cutting flapper valve comprises:

a hydraulic piston housing with a hydraulic cylinder head that forms a chamber therein;

a piston with a piston seal slidably disposed in the chamber, the piston having a longitudinal bore through the piston so that an object can pass through the flapper valve when the flapper valve is open;

at least one cut-off blade rotatably coupled to the valve and configured to be closed by a first end of the piston when the piston is actuated toward the cut-off blade and cut across the bore through the object disposed in the flapper valve; and a flapper rotatably coupled to the valve below the cut-off blade and configured to close and seal the bore in a closed position, and to open and allow the object to pass through the valve in an open position when the piston is actuated to move the flapper;

wherein the piston in configured to move in a first direction to open the flapper and allow the cut-off blade to open, and the piston in configured to move in a second direction to close the cutoff blade and allow the flapper to close.

6. The wireline lubricator of claim 5, further comprising a lifting cage coupled to the piston and configured to open the at least one cut-off blade during movement of the piston.

7. The wireline lubricator of claim 1, wherein the cutting flapper valve is hydraulically actuated.

8. The wireline lubricator of claim 1, wherein the cutting flapper valve comprises at least one cut-off blade rotatably coupled to the valve across a longitudinal bore of the valve and a flapper rotatably coupled to the valve below the cut-off blade.

9. The wireline lubricator of claim 8, wherein the flapper is configured to close across the bore after a wireline has been cut by the at least one cut-off blade, and the wireline drops from the cut-off blade past the flapper to allow the flapper to close across the bore.

10. A method of mounting a wireline lubricator with a cutting flapper valve, wherein a wireline can be inserted through the cutting flapper valve in an oil or gas well, comprising:

inserting the wireline lubricator through an opening in a wellhead on the oil or gas well;

extending the wireline lubricator into the well so that the cutting flapper valve is below the wellhead;

fixedly coupling the wireline lubricator to the wellhead; and the cutting valve capable of cutting by shearing a wireline inserted through the cutting flapper valve and afterwards sealing the cutting flapper valve below the cutting.

11. The method of claim 10, further comprising:

cutting the wireline with a cut-off blade coupled to the valve;

allowing the wireline to drop by gravity from the cut-off blade past the flapper; and closing the flapper valve with a flapper across a bore of the flapper valve.

12. A method of using a wireline lubricator installed in an oil or gas well at least partially below a wellhead, comprising:

inserting a wireline and a tool through a bore in the wireline lubricator to an elevation below the wellhead;

cutting by shearing the wireline below the wellhead and allowing the tool to drop by gravity while the lubricator is installed at least partially below the wellhead; and sealing the bore of the wireline lubricator after the wireline drops by gravity while the lubricator is installed at least partially below the wellhead.

13. The method of claim 12, wherein:

cutting the wireline below the wellhead and allowing the tool to drop by gravity while the lubricator is installed at least partially below the wellhead comprises cutting with a cut-off blade coupled to the valve; and sealing the bore of the wireline lubricator after the wireline drops by gravity while the lubricator is installed at least partially below the wellhead comprises sealing comprises allowing the wireline to drop past a flapper coupled to the flapper valve to allow the flapper to close.

* * * * *